US008777818B1

(12) United States Patent
Tate, Jr.

(10) Patent No.: US 8,777,818 B1
(45) Date of Patent: Jul. 15, 2014

(54) TRAINING DEVICE

(76) Inventor: Larry E. Tate, Jr., Brooklyn, NY (US)

( * ) Notice: Subject to any disclaimer, the term of this patent is extended or adjusted under 35 U.S.C. 154(b) by 624 days.

(21) Appl. No.: 12/928,995

(22) Filed: Dec. 22, 2010

(51) Int. Cl.
*A63B 69/00* (2006.01)
*A63B 69/34* (2006.01)

(52) U.S. Cl.
CPC ..... *A63B 69/004* (2013.01); *A63B 69/34* (2013.01); *A63B 2220/53* (2013.01)
USPC ..... 482/83

(58) Field of Classification Search
CPC ... A63B 69/004; A63B 69/34; A63B 2220/53
USPC ..... 482/83–90; 601/23, 33–34; 901/1–50
See application file for complete search history.

(56) References Cited

U.S. PATENT DOCUMENTS

| | | | | |
|---|---|---|---|---|
| 3,250,533 | A * | 5/1966 | Nicholson | 482/83 |
| 4,401,303 | A * | 8/1983 | Anderson et al. | 482/4 |
| 5,425,133 | A * | 6/1995 | Yasuhara et al. | 700/249 |
| 5,971,398 | A * | 10/1999 | Broussard et al. | 273/408 |
| 6,110,079 | A * | 8/2000 | Luedke et al. | 482/83 |
| 6,139,328 | A * | 10/2000 | Picotte | 434/256 |
| 6,152,863 | A * | 11/2000 | Nelson et al. | 482/83 |
| 6,155,960 | A * | 12/2000 | Roberts et al. | 482/83 |
| 6,416,445 | B1 * | 7/2002 | Nelson et al. | 482/83 |
| 6,493,606 | B2 * | 12/2002 | Saijo et al. | 700/245 |
| 6,580,969 | B1 * | 6/2003 | Ishida et al. | 700/245 |
| 6,802,382 | B2 * | 10/2004 | Hattori et al. | 180/8.6 |
| 6,832,132 | B2 * | 12/2004 | Ishida et al. | 700/245 |
| 7,066,896 | B1 * | 6/2006 | Kiselik | 601/5 |
| 7,099,747 | B2 * | 8/2006 | Mikami et al. | 700/245 |
| 7,828,701 | B1 * | 11/2010 | Chen | 482/83 |
| 2001/0030523 | A1 * | 10/2001 | Mori et al. | 318/568.12 |
| 2004/0236467 | A1 * | 11/2004 | Sano | 700/245 |
| 2004/0248633 | A1 * | 12/2004 | Trawick et al. | 463/8 |
| 2008/0114491 | A1 * | 5/2008 | Takahashi | 700/245 |
| 2008/0161970 | A1 * | 7/2008 | Adachi et al. | 700/253 |
| 2009/0125145 | A1 * | 5/2009 | Adachi et al. | 700/250 |
| 2009/0171505 | A1 * | 7/2009 | Okazaki | 700/258 |
| 2009/0285664 | A1 * | 11/2009 | Kim et al. | 414/730 |
| 2010/0130329 | A1 * | 5/2010 | Sullivan et al. | 482/4 |
| 2010/0139437 | A1 * | 6/2010 | Ichikawa et al. | 74/490.05 |
| 2010/0259057 | A1 * | 10/2010 | Madhani | 294/106 |
| 2011/0040410 | A1 * | 2/2011 | Kim et al. | 700/260 |
| 2011/0067479 | A1 * | 3/2011 | Davis et al. | 73/1.75 |
| 2011/0071675 | A1 * | 3/2011 | Wells et al. | 700/250 |
| 2011/0077775 | A1 * | 3/2011 | Nagasaka et al. | 700/254 |
| 2011/0106307 | A1 * | 5/2011 | Kim et al. | 700/246 |
| 2011/0245045 | A1 * | 10/2011 | Blaies | 482/84 |
| 2011/0256990 | A1 * | 10/2011 | Machado et al. | 482/83 |

* cited by examiner

*Primary Examiner* — Loan H Thanh
*Assistant Examiner* — Andrew S Lo
(74) *Attorney, Agent, or Firm* — Kenyon and Kenyon LLP

(57) ABSTRACT

A training device for use in the various martial arts and other competitive sports that responds to a person using the training device. A torso sits on a base, a head is attached to the torso, arms are attached to the torso, and legs may be attached to the torso. Sensors on the torso, head, arms and legs communicate with means for moving the head, torso, arms and legs. A means for controlling the movement of the components can be programmed to move the components in response to, or independently of, the actions of a user of the device.

21 Claims, 14 Drawing Sheets

TRAINING DEVICE

BACKGROUND

Punching dummies or other targets (including punching bags, punching targets, and kicking targets) are utilized in physical training to provide a target for the application of force by a user against a device. The punching dummies and other targets may also be used as a part of an exercise regime to assist users in strengthening muscles and in improving their technique in the various martial arts and other competitive sports.

Conventional punching dummies and other targets either remain passive or provide minimal movement. If they do move, the movement is not in response to the movements of a user of the device and they do not provide for programming and varying the types of movements made by the training device or a target. In addition, they do not provide for programming and varying the specific portions of a training device or target that will respond to the actions of a user.

For people wishing to train while simulating a real competitive experience, a sparring partner is required. Practicing specific techniques, such as martial arts arm blocks, requires a partner to strike toward the trainee's direction, something that cannot be done while training alone. Some devices in the past have attempted to simulate human action, such as by having a motorized sword that spins around at a set interval or a mechanized arm that regularly contracts and extends forward and back. These lack an interactive feature and the training device does not respond to user input, but instead simply functions in a repetitive continuous fashion, which makes them highly predictable and reduces their training effectiveness. Practice of competitive sports such as boxing, karate, tae kwon do, aikido, and kung fu for example requires at least two people for best results. However, because it is not always possible for one person to have a partner available, or because it may be dangerous to practice some advanced moves on a human partner, as the next best alternative, a mechanical partner would be most useful.

Another conventional training method is to practice with a stationary, non-interactive dummy (a "punching bag" type dummy). One shortcoming of this conventional approach is that it does not simulate actual conditions or allow the user to practice realistic offensive techniques—and provides no practice at all for defensive techniques. Furthermore, training with a conventional practice dummy does not allow for the practice session to be adjusted to the user's level of expertise.

Currently, those seeking to train or learn the various martial arts and other combat type sports do so either by training with another individual, e.g., a training partner or a professional instructor which can be difficult to schedule at a mutually convenient time and can also be costly, both in fees for the instructor and in fees for gym time. In addition, training with a human training partner may also result in injury to the training partner.

There is a need for such devices for use in training and teaching the various martial arts and other combat type sports such as boxing or any of the various fighting styles employed by competitors in events such as the Ultimate Fighting Championship ("UFC"). There is a need for such a device that contains a central processing unit ("CPU"), i.e., a computer, microchips, or the like that can be programmed to interact with and respond to a user or to operate independently of the actions of a user. This type of device will reduce injuries from sparring with another person, allow for beginners to train using multiple techniques at various speeds, and allows a person to train at any time during the day.

SUMMARY

The present invention is directed to a device for competitive martial arts training that can be programmed to interact with and respond to a user of the device when the user makes physical contact with one or more of the user contact sensors disposed on the device or when a user of the device activates one or more user motion sensors disposed on the device. The components of the device may also be programmed to move independently of any actions of the user of the device. The device allows the user to practice both offensive and defensive techniques that are appropriate for the user's level of skill without requiring a training partner, i.e., the user can practice alone.

The present invention solves the cost and scheduling problems associated with attempting to schedule time in a gym for an individual to train or learn the various martial arts or other combat type sports by training with another person. The present invention allows for training without a partner, eliminates potential injuries to a training partner, and provides an interactive customized competitive training device that allows the user to conveniently practice, without a training partner, both offensive and defensive techniques that can be adjusted to the individual's experience, skill, and level of expertise.

This type of device will reduce injuries from sparring with another person, will allow for beginners to practice multiple techniques at various skill levels and speeds, and will allow a person to train at any time during the day without requiring a training partner.

The present invention is directed to an apparatus that satisfies this need. The apparatus comprises a base and a torso attached to the base, the torso having a right side, a left side, a top end, and a bottom end, the bottom end having right side and a left side. A torso waist joint connector attaches the bottom end of the torso to the base. A head is attached to the top end of the torso by a head neck joint connector. A right arm is attached to the right side of the torso and a left arm is attached to the left side of the torso. A right arm shoulder joint connector attaches the right arm to the right side of the torso and a left arm shoulder joint connector attaches the left arm to the left side of the torso. A means for moving the torso is provided on the torso, a means for moving the head is provided on the head, and a means for moving the arms is provided on the arms. The means for moving may be, e.g., electronic, hydraulic, magnetic, compressed air, pneumatic, and counter-weights.

A plurality of user contact sensors, e.g., pressure sensors, are disposed on the components of the device for sensing the contact of a user of the device with the user contact sensors. The user contact sensors communicate with and cooperate with the means for moving the torso, the means for moving the head, and the means for moving the arms, to move the torso, head, and arms in response to the contact of a user of the device sensed by the user contact sensors.

A plurality of user motion sensors are disposed on the components of the device for sensing the motion of, or a change in the proximity or distance of, a user of the device. The user motion sensors communicate with and cooperate with the means for moving the torso, the means for moving the head, and the means for moving the arms to move the torso, head, and arms in response to the movements of, or a change in the proximity of or distance of, a user of the device sensed by the user motion sensors. The user motion or proximity sensors may be, e.g., infrared, ultrasonic or microwave sensors.

The arms may be provided with hands permanently attached to, or removably attached to, the arms. The hands may be provided with a palm and may also be provided with a thumb and fingers, i.e, digits, and sensors, and means for moving the digits in order to selectively open and close the hand.

A means for controlling the movement of the components of the device communicates with the user motion sensors, the user contact sensors, and the means for moving the torso, and the means for moving the head, and the means for moving the arms and may be programmed to selectively control the movement of one or more of the components of the device, e.g., the torso, head, and arms, either in response to the actions of a user of the device or independently of any actions by the user of the device.

The torso may be provided with legs and the legs may be provided with feet. The legs and feet may be provided with sensors and means for moving the legs that communicate with the means for controlling the movement of the components of the device in order to selectively move the legs and the feet either in response to the actions of a user of the device or independently of any actions by the user of the device.

The present invention is also directed to a method of training or learning the various martial arts or other combat-type sports using a device for competitive training according to any of the described embodiments.

These and other features, aspects, and advantages of the present invention will become better understood with regard to the following description, appended claims, and accompanying drawings.

DESCRIPTION

Figure 1:
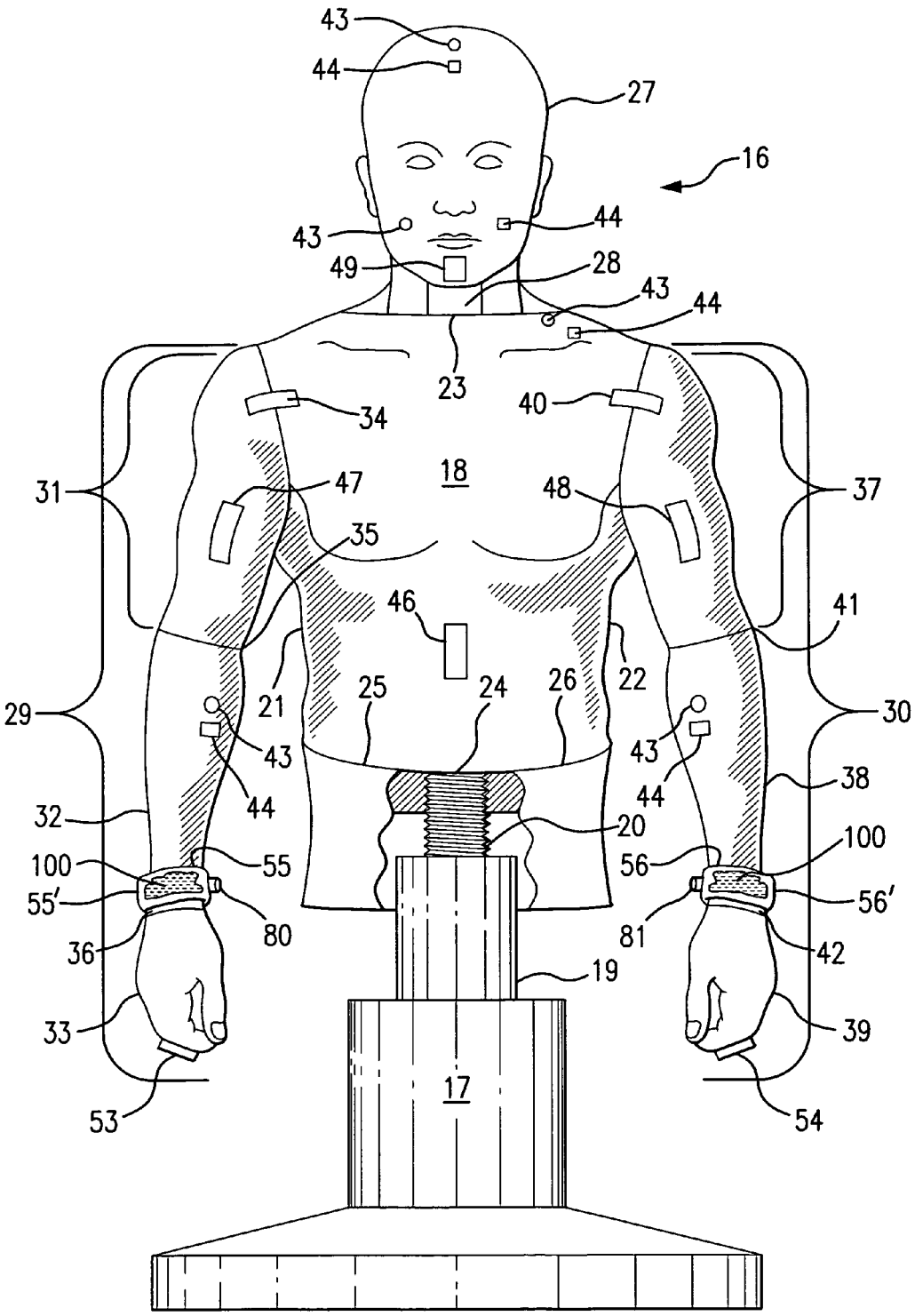
FIG. 1 is a frontal view of an embodiment of a training device according to this invention.

FIG. 1 is a frontal view of an embodiment of the present invention. The device 16 comprises several components as discussed below. A torso 18 is attached to a base 17 by a torso waist joint connector 19 that allows the torso 18 to move relative to the base 17. The torso waist joint connector 19 may be provided with a means for adjusting the height of the torso 20 above the base 17. The means for adjusting the height of the torso 20 could be, e.g., a threaded engagement or an adjustable pin or an adjustable screw. The torso 18 has a right side 21, a left side 22, a top end 23, and a bottom end 24. The bottom end 24 of the torso 18 has a right side 25 and a left side 26. A head 27 is connected to the torso 18 via a head neck joint connector 28 that allows the head 27 to move relative to the torso 18. A means for moving the torso 46 allows for the torso 18 to selectively move in response to, or independently of, the actions of a user of the device 16.

A right arm 29 is connected to the right side 21 of the torso 18 and a left arm 30 is connected to the left side 22 of the torso 18. The right arm 29 is comprised of several components, including a right upper arm 31, a right lower arm 32, and a right hand 33. The right arm 29 moves relative to the torso 18 via a right arm shoulder joint connector 34. The right lower arm 32 moves relative to the right upper arm 31 via a right upper arm and right lower arm elbow joint connector 35. The right hand 33 may be integrally formed with and move in unison with the right lower arm 32. Alternatively, the right hand 33 can move relative to the right lower arm 32 via a right wrist joint connector 36, e.g, a swivel wrist joint connector. The right hand 33 may be removable from the right lower arm 32. The right hand 33 may be shaped to form an open hand comprising a palm and may also comprise fingers and a thumb, collectively the digits. In one embodiment, there is no open space between the fingers and there is no open space between the "pointer" finger and the thumb. Alternatively, the right hand 33 may be shaped to form a clenched fist. A means for moving the right arm 47 allows for selective movement of the components of the right arm 29 in response to, or independently of, the actions of a user of the device 16.

The left arm 30 is comprised of several components, including a left upper arm 37, a left lower arm 38, and a left hand 39. The left arm 30 moves relative to the torso 18 via a left arm shoulder joint connector 40. The left lower arm 38 moves relative to the left upper arm 37 via a left upper arm and left lower arm elbow joint connector 41. The left hand 39 may be integrally formed with and move in unison with the left lower arm 38. Alternatively, the left hand 39 can move relative to the left lower arm 38 via a left wrist joint connector 42, e.g., a swivel wrist joint connector. The left hand 39 may be removable from the left lower arm 38. The left hand 39 may be shaped to form an open hand comprising a palm and my also comprise fingers and a thumb, collectively the digits. In one embodiment, there is no open space between the fingers and there is no open space between the "pointer" finger and the thumb. Alternatively, the left hand may also be shaped to form a clenched fist. A means for moving the left arm 48 allows for selective movement of the components of the left arm 30 in response to, or independently of, the actions of a user of the device 16.

The head 27 is attached to the torso 18 by a head neck joint connector 28 that allows the head 27 to rotate or swivel, or move in an up and down direction, or move in a forward and backward direction relative to the torso 18. A means for moving the head 49 allows for selective movement of the head 27 in response to, or independently of, the actions of a user of the device 16.

The means for moving the torso 46, and the means for moving the right arm 47, and the means for moving the left arm 48, and the means for moving the head 49 of the device 16 may be selected from a variety of means for moving well known to those skilled in the art as suitable for this purpose and may be selected from the group consisting of, e.g., mechanical, electrical, hydraulic, magnetic, compressed air, pneumatic, servomotors, and micromotors. The means for moving the torso 46, the means for moving the right arm 47, and the means for moving the left arm 48, and the means for moving the head 49 may cooperate with one or more linkages, e.g., gears, rods, wires, pulleys, chains, tubing, and springs to selectively activate or move the components of the device 16.

FIG. 1 also shows that there may be one or more user contact sensors 43 distributed at predetermined locations on the components of the device 16, e.g., the torso 18, the head 27, and the arms 29, 30 which can sense contact by a user of the device 16 with the user contact sensors 43. The user contact sensors 43 communicate with the means for moving the torso 46, the means for moving the right arm 47, the means for moving the left arm 48, and the means for moving the head 49 and the means for controlling the movement of the components of the device 45 (best shown in FIGS. 15 and 16 and discussed below) to initiate and control the movement of one or more of the components of the device 16, e.g., the torso 18, the head 27, and the arms 29, 30 in response to contact of a user of the device 16 with a user contact sensor 43 disposed on the device 16. In a preferred embodiment, the user contact sensors 43 are pressure sensors. The pressure sensors 43 may be discrete individual sensors disposed at preselected positions on the components of the device 16, as shown for example in FIG. 1. Alternatively, the pressure sensors 43 may comprise a pressure sensitive sheet, or laminate, or "skin," e.g., a pressure sensitive film or membrane applied to selected portions or to all of, the external surface of the components of the device 16.

FIG. 1 also shows that there may be one or more user motion sensors 44 distributed at predetermined locations on the device 16, e.g., the torso 18, the head 27, and the arms 29, 30, which can sense the motion of, or a change in the distance or the proximity of, a user of the device 16 with respect to the device 16 and can trigger movement of the torso 18, the head 27, and the arms 29, 30 in response to sensing the motion of, or a change in the distance or the proximity of, a user of the device 16. As used herein, a user motion sensor is a sensor capable of sensing either the movement of a user of the device or a change in the proximity of a user of the device, or a change in the distance between a user of the device and a user motion sensor 44 disposed on the device 16. In a preferred embodiment, the user motion sensors 44 may be selected from the group consisting of, e.g., infrared, ultrasonic and microwave sensors. The user motion sensors 44 communicate with the means for moving the torso 46, the means for moving the arms 47,48 and the means for moving the head 49, and the means for controlling the movement of the components of the device 45 (best shown in FIGS. 15 and 16 and discussed below) to initiate and control the movement of one or more of the components of the device, e.g, the torso 18, the head 27, and the arms 29, 30 in response to the motion of, or change in distance or proximity of, a user of the device 16 sensed by the user motion sensors 44.

The change in distance or proximity between the user of the device 16 and the motion sensor 44 disposed on the device 16 and the amount of movement made by a user of the device 16 required to activate the motion sensors 44 may be pre-programmed directly into the user motion sensors 44 or may be varied by programming the desired parameters into the means for controlling the movement of the components of the device 45. The user motion sensors 44 could detect the motion of a user of the device 16 or a change in the distance or proximity between the user of the device 16 and the sensors 44 disposed on the device 16. For example, the user motion sensors 44 may sense a motion by the user of the device 16, e.g., drawing his arm back, i.e, away from the device 16, to prepare to throw a punch. The user motion sensors 44 may also sense a change in the proximity or distance of a user of the device 16, e.g., when a user throws a punch or initiates a kick which brings the user's hand or foot into closer proximity with the user motion sensors 44 disposed on the device 16. The motion sensors 44 function much like the motion or proximity sensors used in many public restrooms to activate water flow in sinks, to activate the hot air flow in hand dryers, to activate the automatic dispensing of paper towels, or to activate the automatic dispensing of soap for washing hands. These devices are activated when the sensors on these devices sense the motion of, or the change in proximity of, a user of the device or that a user has moved within a preselected proximity or distance from the sink, hand dryer, paper towel dispenser, or soap dispenser, e.g., from about six inches to about two feet. Such sensors activate the device to perform its function when the sensor senses motion by the user or that the user has moved within a specified distance. When the user moves away from the device or moves outside the specified activation distance, the sensors then deactivate, i.e., turn the device "off". The motion or proximity sensors of the present invention work in much the same manner.

A means for controlling the movement of the components of the device 45 is provided (shown best in FIGS. 15 and 16) and cooperates with the user contact sensors 43, the user motion sensors 44 and the means for moving the torso 46, and the means for moving the arms 47, 48, and the means for moving the head 49. The means for controlling the movement of the components of the device 45 may be programmed to selectively trigger movement of one or more components of the device, e.g., the torso 18, the head 27, and the arms 29, 30 in response to contact by a user of the device 16 sensed by a user contact sensor 43 disposed on the device 16. The means for controlling the movement of the components of the device 45 may also be programmed to selectively move one or more of the components of the device in response to the motion of, or a change in the distance or proximity of, a user of the device 16 sensed by a user motion sensor 44 disposed on the device 16. In a preferred embodiment, the user contact sensors 43 and the user motion or proximity sensors 44 are disposed on those portions of the components of the device 16 that would correspond to the following martial arts target locations of the human body: the temples; solar plexus, throat, hands, liver, kidney, lower abdomen, groin, and legs.

The means for controlling the movement of the components of the device 45 may comprise a control panel comprising a plurality of manually operated controls, e.g., switches or dials. Alternatively, the means for controlling the movement of the components of the device 45 may be a central processing unit ("CPU"), e.g., a computer that can be programmed or can receive programmed cards or discs to provide a variety of customized training scenarios, much like the variety of training scenarios available on training devices such as stationary bicycles and treadmills. The means for controlling the movements of the components of the device 45 communicates with the user contact sensors 43, the user movement sensors 44, and the means for moving the torso 46, and the means for moving the head 49, and the means for moving the arms 47, 48, and the means for sensing the impact of the hands 53, 54, to control the movements of the components of the device 16, either in response to the actions of a user of the device or independently of the actions of a user of the device. The means for controlling the movement of the components of the device 45 may also be programmed so that only specific preselected portions of the components of the device 16 are activated either in response to, or independently of, the actions of a user of the device 16.

The means for controlling the movement of the components of the device 45 may be programmed so that only specific preselected sensors 43, 44 on specific preselected portions of the components of the device 16 are activated by the contact of, or the motion of, or a change in the distance or proximity of, a user of the device 16. For example, the device could be programmed so that only preselected user contact sensors 43 on the right temple of the head 27 will be activated by a user's contact. The means for controlling the movement of the components of the device 45 may also be programmed so that only specific preselected portions of the components of the device 16 are activated either in response to, or independently of, the actions of a user of the device 16. The means for controlling the movement of the components of the device 45 cooperates with the means for moving the torso 46, the means for moving the arms 47,48 and the means for moving the head 49 to control the speed with which the components of the device move, and the frequency with which they move, either in response to, or independently of, any action or stimulus provided by a user of the device 16. This allows for custom drills and training that can be adjusted to the level of skill and speed of the user of the device 16. For example, the device could be programmed to throw a left jab having a frequency of every 5 seconds for a beginner or every 2 seconds for someone with advanced skill. The speed of the jab could also be varied, e.g., The device 16 could also be programmed to throw a slow or "lazy", almost playful, left jab or, alternatively, a fast or "crisp" or "sharp" left jab that a professional boxer might throw, as specific training needs and skill levels of the user dictate.

The means for controlling the movement of the components of the device 45 may be programmed so that movement of the head 27 may be programmed to be independent of the actions of a user of the device 16, e.g., continuous "bobbing and weaving." Alternatively, the means for controlling the movement of the components of the device 45 may be programmed to move the components of the device, e.g., the head 27 in a preselected manner, e.g., by pulling the head backwards when the head 27 is struck at a user contact sensor 43 disposed on the head 27 or when movement of, or a change in the proximity of, a user of the device 16 is sensed by a user motion or proximity sensor 44 disposed on the head 27. In one embodiment, the means for controlling the movement of the components of the device 45 is programmed to return the head 27 to its original position after the head 27 has moved either in response to being struck by a user of the device 16 sensed by the user contact sensors 43 or in response to the motion of, or change in proximity of, a user of the device sensed by a user motion sensor 44 disposed on the head.

The means for controlling the movement of the components of the device 45 may also, e.g., be programmed so that the torso 18 and the head 27 rotate or swivel or move relative to the base 17 in response to, or independently of, the movement of a user of the device 16. These movements of the components of the device 16 may be programmed to move in a programmed pattern or may be programmed to move in a random pattern. The means for controlling the movement of the components of the device 45 may also be programmed so that, e.g., the arms, head and torso move so as to simulate an opponent's motions, e.g., a boxer's offensive or defensive motions. For example, the left arm may be programmed to "jab" or to be raised so as to block an incoming punch sensed by a user contact sensor 43 or a user motion sensor 44 and the right hand may be programmed to throw an uppercut in response to an incoming punch sensed by a user contact a sensor 43 or a user motion sensor 44. The movements of the components of the device 16 may be programmed to be in response to, or independent of, any movement of, or contact by, a user of the device 16 and the movements of the device may be programmed to move in a programmed pattern or may be programmed to move in a random pattern as specific training requirements dictate.

The means for controlling the movement of the components of the device 45 allows the user to select and program the duration, frequency, pattern, and the speed, of and the types of actions that the components of the device will make. Depending on the type of training desired, a user can activate all of the user contact sensors 43 and all of the user motion sensors 44 so that all of them will respond to the motion of, or the contact by, a user of the device. Alternatively, the user may choose to program the device 16 so as to only activate the user contact sensors 43, or to only activate the user motion sensors 44, or to activate only some of the user contact sensors 43 and to activate only some of the user motion sensors 44. The means for controlling the actions of the components of the device 45 may also be programmed to control the specific components of the device 16 that will respond to actions of a user of the device 16 and the speed of the response and the frequency of the response. These movements of the device 16 may be in response to actions of the user of the device or they may be completely independent of any actions of the user.

The device 16 may be programmed to move one or more components of the device 16, e.g., the torso 18, the head 27, and the arms 29, 30 for movement that is independent of the actions of, or any stimulus provided by, a user of the device. For example, in one training scenario, the components of device 16 may be programmed to move in a predetermined pattern or may be programmed to move in a random pattern regardless of any movement or contact by the user of the device.

The device 16 may also be programmed to move one or more of the components of the device 16, e.g., the torso 18, the head 27, and the arms 29,30 of the device in response to the actions, i.e, the movement of, or the contact by, a user of the device 16. For example, the components of the device 16 may be programmed to move and respond in a predetermined pattern or may be programmed to move in a random pattern in response to sensed contact or sensed motion or change in distance or proximity of a user of the device 16 sensed by preselected user contact sensors 43 or preselected user motion sensors 44.

Figure 7:
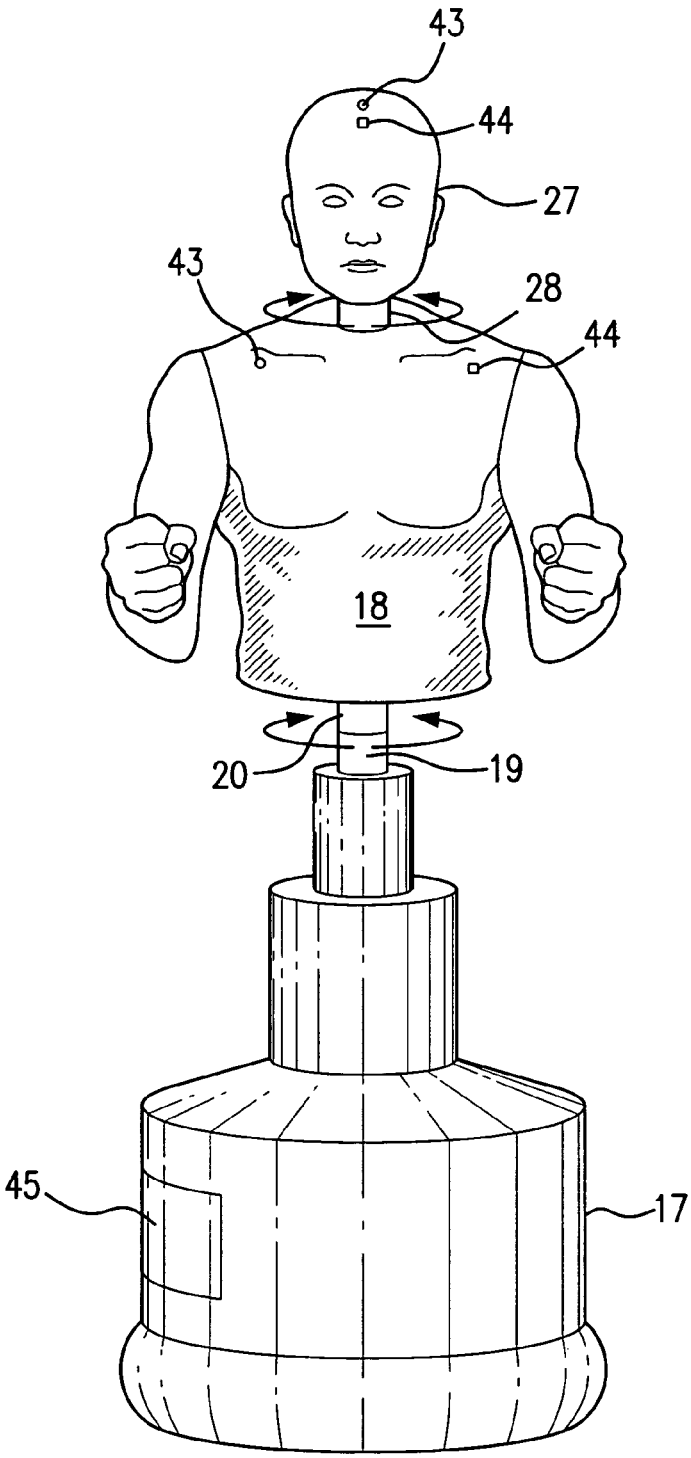
FIG. 7 is a frontal view of a training device according to an embodiment of the invention showing the swivel motion of the torso about the base and the swivel motion of the head about the torso.

Referring to FIGS. 1 and 7, the torso 18 is attached to the base 17 via a torso waist joint connector 19 and may rotate or swivel about the base 17 via a swivel torso waist joint connector 19' (shown in FIG. 2) when the torso 18 is struck by the user at a user contact sensor 43 or when motion of, or a change in distance or proximity of, a user of the device 16 is sensed by a user motion sensor 44 disposed on the torso 18. Alternatively, the torso waist joint connector 19 may be a flexible corrugated accordion spring type connector with a memory, which will allow side to side and forward and back movement of the torso 18 in response to being struck and then, because of its memory, will return the torso 18 to its original position after being struck by a user of the device 16.

To reduce the impact of the hands 33, 39 of the device 16 when they punch or contact a user of the device 16, a means for sensing the impact of the hands 53, 54 is provided to sense the impact of the hands 33, 39 of the device 16 upon a user of the device 16 when the hands 33, 39 of the device 16 impact against, e.g., "punch", a user of the device 16. A right means for sensing the impact of the right hand 53 of the device 16 with a user of the device 16 is disposed on the right hand 33 of the device 16. A left means for sensing the impact of the left hand 54 of the device 16 with a user of the device 16 is disposed on the left hand 39 of the device 16. Both the right means for sensing the impact of the right hand 53 and the left means for sensing the impact of the left hand 54 cooperate with the means for controlling the movement of the components of the device 45 and the means for moving the arms 47, 48 so as to decelerate the thrust of the arms 29, 30 upon sensing contact of the hand 33, 39 with a user of the device 16. This deceleration more realistically simulates the deceleration that naturally occurs when a punch is landed by a person on another person and also reduces the likelihood of injury to a user of the device 16.

In order to soften the blows when the hands 33,39 of the device strike a user of the device 16, the device 16 may be provided with a right hand impact attenuator 55 disposed between the right hand 33 and the right lower arm 32. A left hand impact attenuator 56 may be disposed between the left hand 39 and the left lower arm 38. The impact attenuator 55, 56 may be comprised of a compressible solid material, e.g., rubber, plastic, or dense foam. The impact attenuator 55,56 may also be comprised of a compressible gel or a compressible fluid 100 contained in a fluid tight housing 55', 56'. The compressible fluid 100 may be a compressible liquid or a compressible gas. In a preferred embodiment, the housing 55', 56' is provided with a valve 80, 81 to control the amount of compressible fluid 100 that can be introduced into, and removed from, the housing 55', 56' that also allows for adjustment of the pressure of the compressible fluid 100 in the housing. In one embodiment, the compressible fluid 100 may be introduced into and removed from the housing 55', 56' using, e.g., an external pump provided with a pressure gauge.

Figure 3:
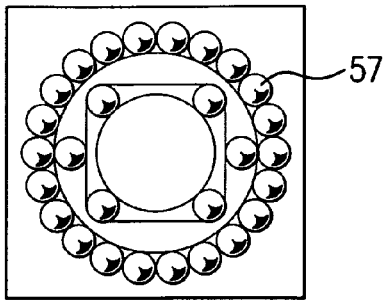
FIG. 3 is a detailed view of the swivel attachments shown in FIG. 2.
Figure 2:
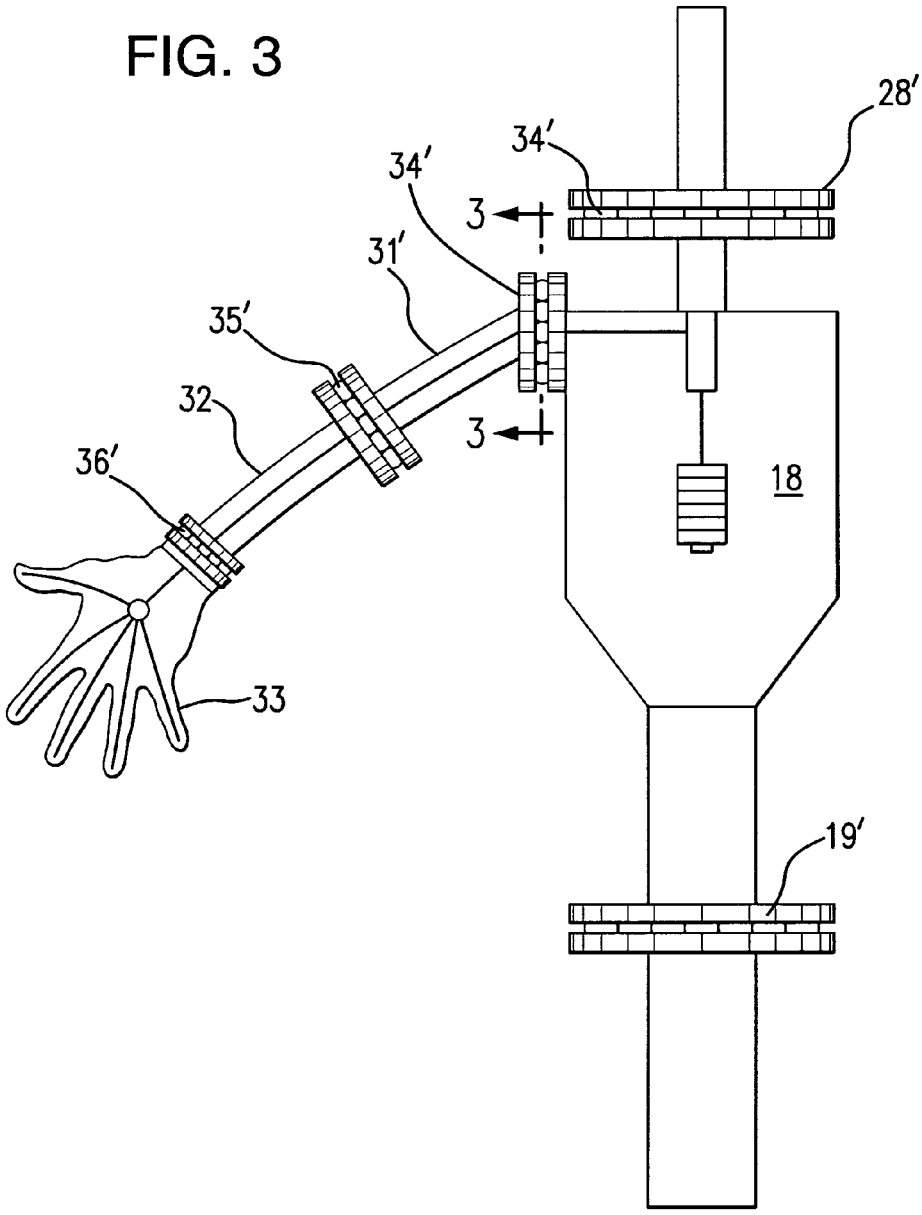
FIG. 2 shows swivel attachments that can be used to move the components of the training device.

As shown in FIG. 2, in one embodiment the head neck joint connector 28 attaching the head 27 to the torso 18 may be a swivel neck connector 28' and the torso or waist joint connector 19 connecting the torso 18 to the base 17 may be a swivel waist joint connector 19'. The right upper arm shoulder joint connector 34 connecting the right upper arm 31 to the torso 18 may be a swivel shoulder joint connector 34', the right upper arm and right lower arm elbow joint connector 35 connecting the right lower arm 32 to the right upper arm 31 may be a right swivel elbow joint connector 35', and the right hand 33 may be attached to the right lower arm 32 via a right swivel wrist joint connector 36'. As shown in FIG. 3, these swivel-type connectors 19', 28', 34', 35', and 36' may comprise a plurality of ball bearings 57 to reduce friction and aid in the smooth movement of the various components of the device 16.

Figure 4A:
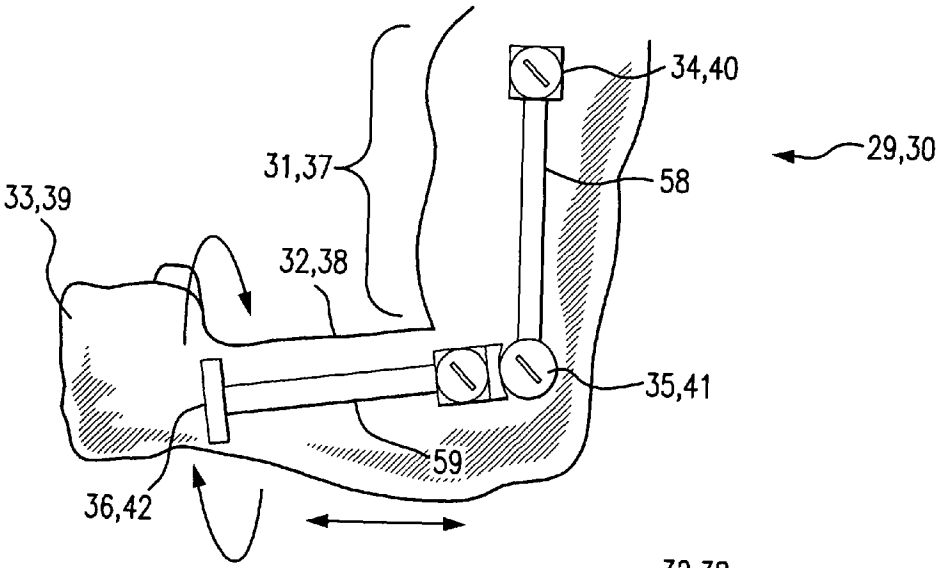
FIG. 4*a* is an interior side view of an arm useful in an embodiment of the invention shown in a bent position.
Figure 4B:
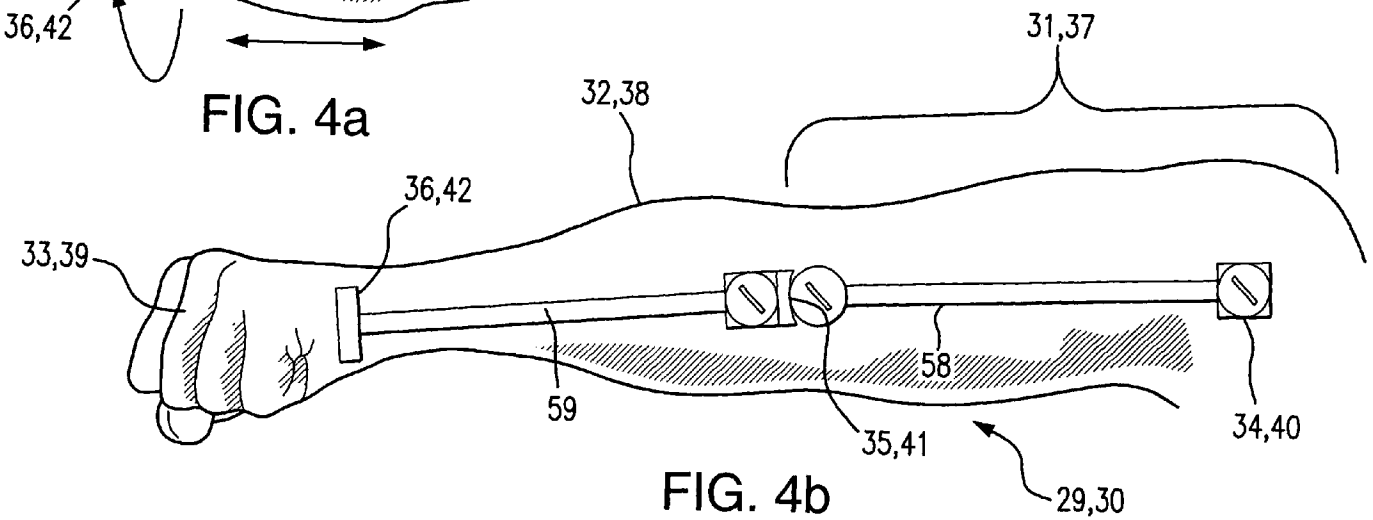
FIG. 4*b* shows the arm of FIG. 4*a* in a straightened position.

Referring to FIGS. 4*a* and 4*b*, the arm 29, 30 may be provided with an upper arm 31, 37, a lower arm 32, 38, and a hand 33, 39. The upper arm 31,37 also may have an upper arm rod 58 which may be attached to the torso 18 via a shoulder joint connector 34,40, e.g., a ball-and-socket joint or a swivel connector 34' (shown in FIG. 2). The lower arm 32, 38 may also be provided with a lower arm rod 59 connected to the upper arm rod 58 by an upper arm and lower arm elbow joint connector 35,41. The upper arm rod 58 and lower arm rod 59 may be comprised of a variety of materials that are sufficiently rigid, durable and suitable for this purpose, e.g., metal, plastic or fiberglass. The hand 33,39 may be attached to the lower arm rod 59 by a wrist joint connector 36, 42, e.g., a swivel wrist joint connector attachment 36' as (shown in FIG. 2).

FIGS. 4*a* and 4*b* show that the arm 29,30 may move between a first bent position (FIG. 4*a*) and a second straight or extended position (FIG. 4*b*) by the pivotal motion of the lower arm 32,38 and lower arm rod 59 relative to the upper arm and lower arm elbow joint connector 35,41. FIG. 4*a* further shows that the hand 33,39 may be rotated or swiveled relative to the lower arm 32,38 and lower arm rod 59 by a rotating or swivel motion about the wrist joint connector 36,42. The hand 33,39 may be manually rotated or swiveled to the desired position and secured in the desired position by the user prior to the start of the training activity. In one embodiment, the degree of rotation of the wrist joint connector 36,42 is approximately 20 degrees in a left and right direction relative to the lower arm 32,38 and may be adjusted manually and rotated to the desired position as specific training requirements dictate so as to simulate the degree of rotation of the human hand relative to the lower arm 32,38.

Figure 5:
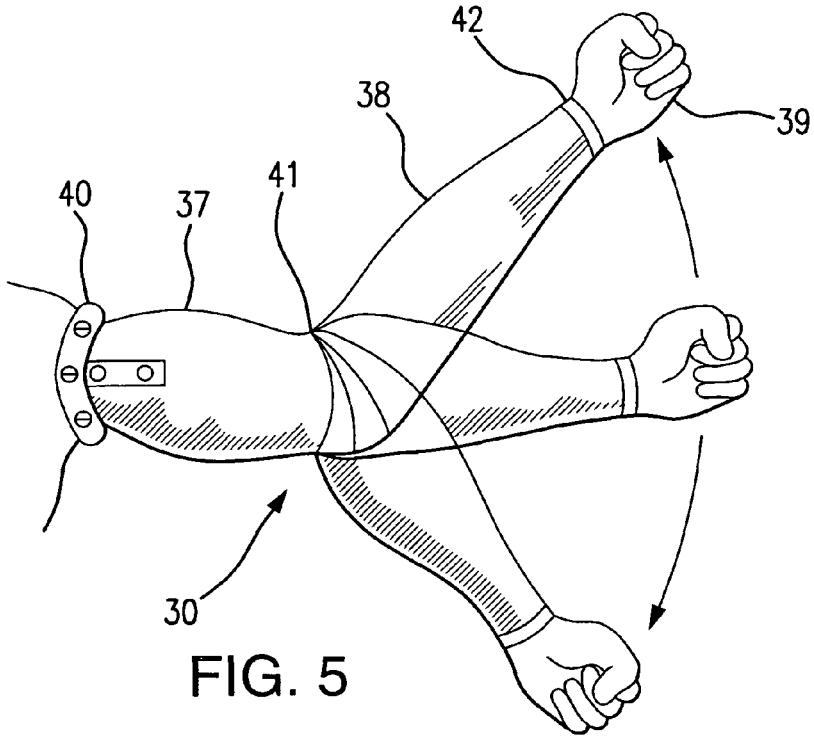
FIG. 5 is a side view of a left arm useful in an embodiment of the invention, showing potential movements about a pivotal elbow joint connector.
Figure 6:
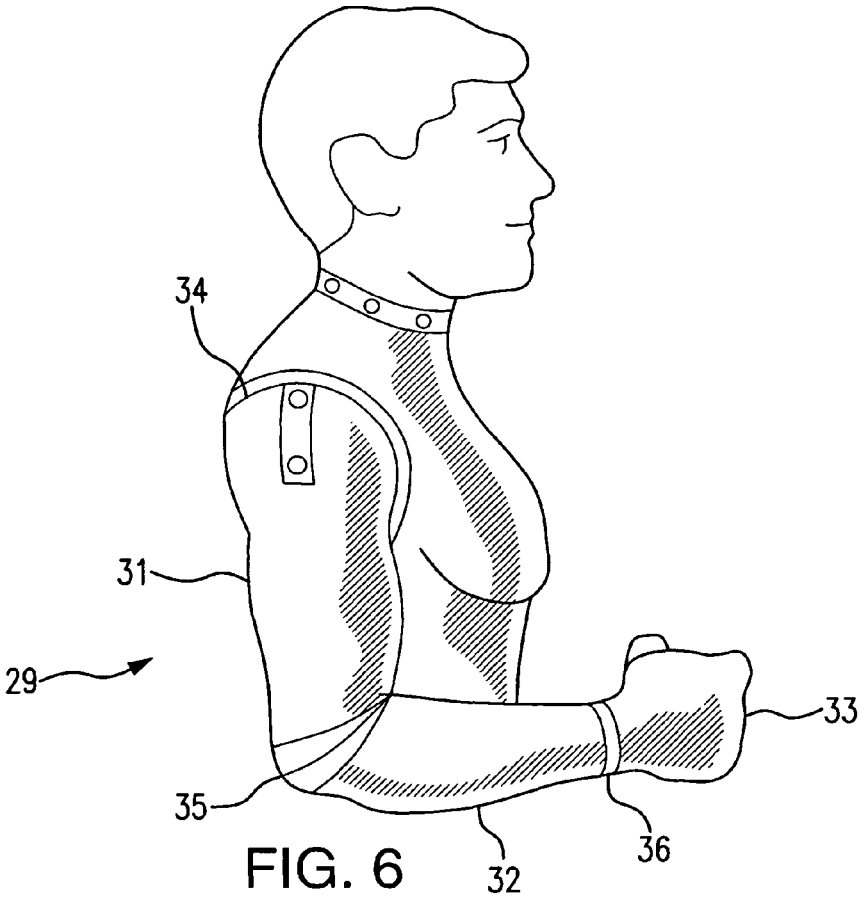
FIG. 6 is a side view of a right arm useful in an embodiment of the invention, showing potential movements about shoulder joint and elbow joint connector.

FIG. 5 shows the pivotal range of motion of the left lower arm 38 relative to the left upper arm 37 via the left upper arm and left lower arm left elbow joint connector 41. FIG. 6 is a side view of the right arm 29 of the device 16 with the right lower arm 32 forming an angle with the right upper arm 31 of about 90 degrees. FIGS. 5 and 6 taken together show how the upper arm 31,37 may move between a first raised position (FIG. 5) to a second lowered position (FIG. 6) via a shoulder joint connector 34,40, e.g., a swivel connector 34' (shown in FIG. 2) or via a ball and socket connector.

FIG. 7 is a frontal view of another embodiment of a training device constructed in accordance with the invention. The arrows show the swivel motion of the torso 18 relative to the base 17 and the swivel motion of the head 27 relative to the torso 18.

Figure 8:
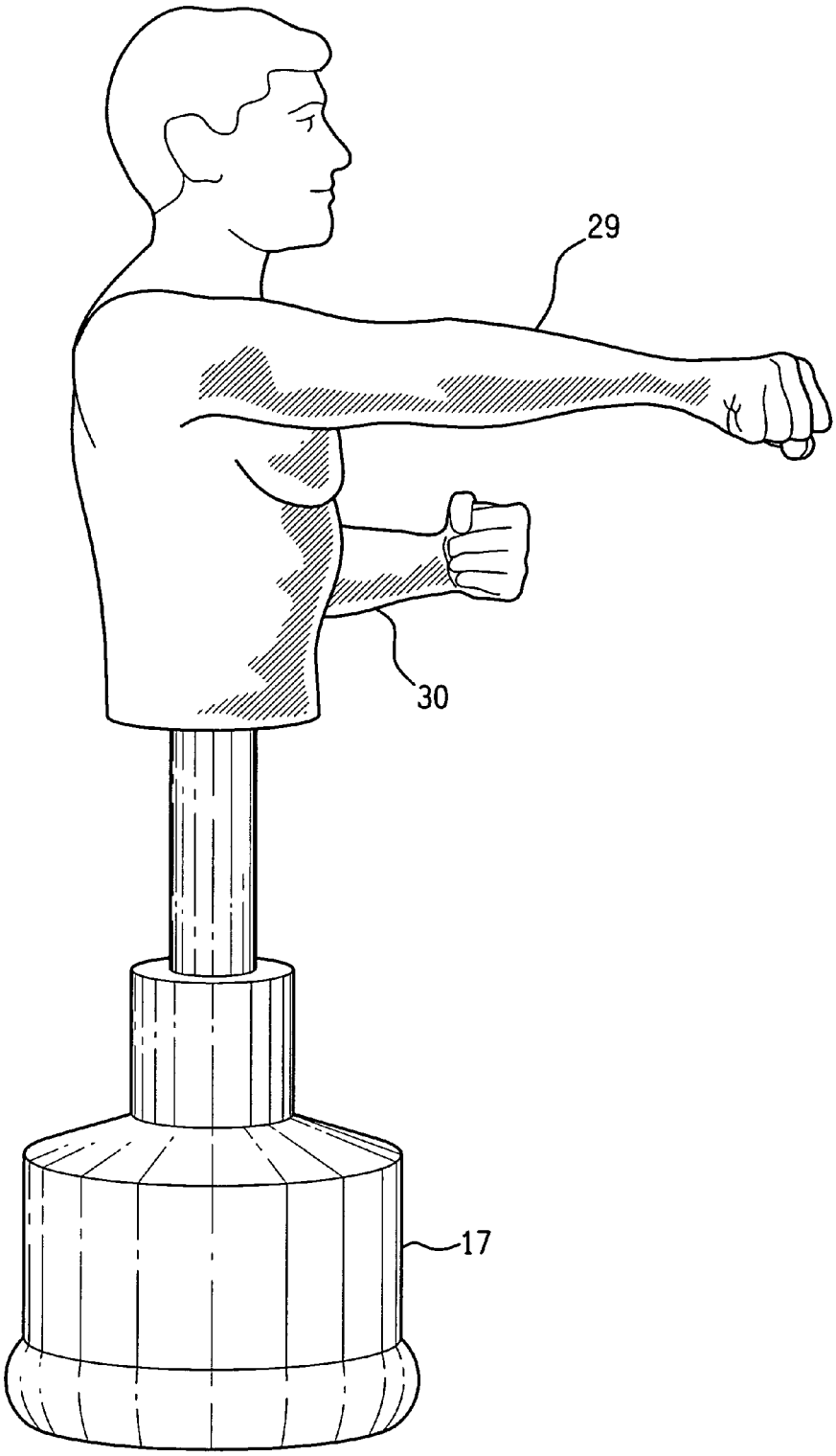
FIG. 8 is a perspective view of a training device according to an embodiment of the invention showing the device attached to a base and the right arm in an extended punching position.

FIG. 8 shows one of the ways that the device 16 may be programmed either to respond to a user of the device 16 or may be programmed to move independently of any actions of a user of the device 16. For example, as shown in FIG. 8, one arm 29 may be programmed to move to a first straightened and raised "punching" position, while the other arm 30 may be programmed to remain in a lowered and bent "guard" position. The movements may be programmed to respond to, e.g., counter, the actions of a user of the device 16 or may be programmed to be independent of any actions of a user of the device 16.

Figure 14:
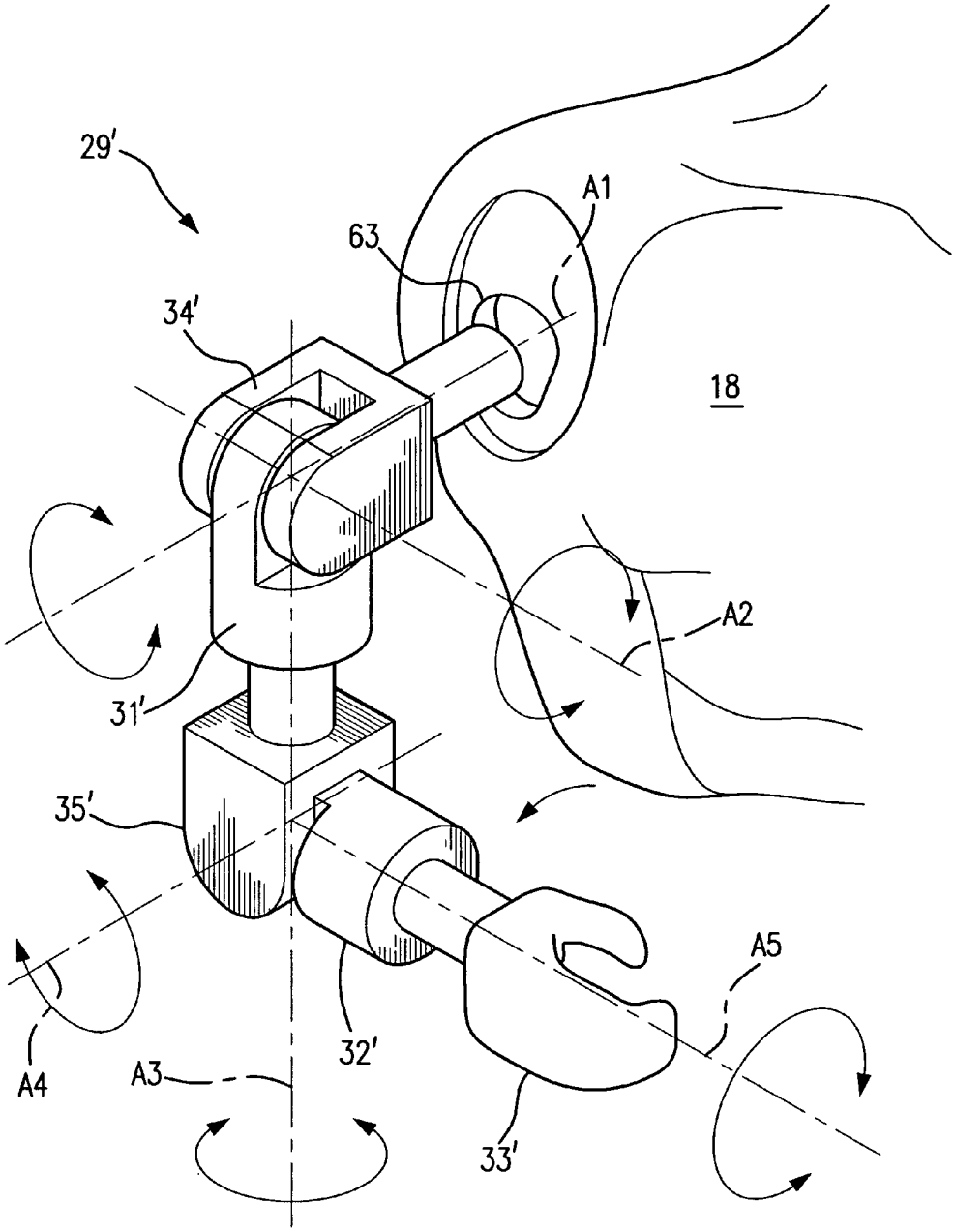
FIG. 14 is an external view of an arm useful in an embodiment of the invention.

FIG. 14 shows a right arm 29' of one particular embodiment of the present invention. The arm 29' of FIG. 14 comprises an upper arm 31' and a lower arm 32', and a hand 33'. The upper arm 31' is attached to the torso 18' by a shoulder attachment 34', which is embedded in a shoulder casing 63 which is also a part of the torso 18'. The upper arm 31' may be connected to the lower arm 32' by an upper arm and lower arm elbow joint connector 35'. The shoulder attachment 34' is attached to the trunk 18' so as to be rotatable around a laterally extending axial line A1. The upper arm 31' is attached to the shoulder attachment 34' so as to be rotatable around a fore-and-aft extending axial line A2. The upper arm and lower arm elbow joint connector 35' is attached to the upper arm 31' so as to be rotatable around a longitudinal axial line A3 of upper arm 31'. The lower arm 32' is attached to the elbow joint connector 35' so as to be rotatable around an axial line A4 substantially perpendicular to the longitudinal axial line A3 of the upper arm 31'. The hand 33' is attached to the lower arm 32' so as to be rotatable around a longitudinal axial line A5 of the lower arm 32'.

Disposed within the torso 18' or within the upper arm 31', or within the upper arm and lower arm elbow joint connector 35', or within the lower arm 32', or within the hand 33', there may be a variety linkages, e.g., gears, rods, wires, pulleys, chains, tubing, and springs that cooperate with one or more means for moving the components of the arm, e.g., servo motors (not shown in FIG. 14). Other means for moving the components of this embodiment of the arm are contemplated and may be selected from a variety of means for moving well known to those skilled in the art as suitable for this purpose and may be selected from the group consisting of, e.g., mechanical, electrical, hydraulic, magnetic, compressed air, pneumatic, and micromotors. The means for moving the components of the arm 29' may cooperate with the one or more linkages, e.g., gears, rods, wires, pulleys, chains, tubing, and springs to selectively activate or move the components of the arm 29'. The arm 29' may also include sensors 43, 44 and microchips 78' which would cooperate with the means for controlling the movement of the components of the device 45 and the means for moving the components of the arm to move the arm 29'.

The components of the arm 29' of FIG. 14 could be programmed to move in various ways. In one such manner of movement, the upper arm 31' may move relative to the torso 18' by the movement of one or more wires or gears which could be connected to the means for moving the components of the arm, e.g., one or more servo motors. The servo motor would cause a wire to move the upper arm 31' between a raised and lowered position via the interaction of the wire and or gears. The servo-motor could be activated to move the arm by the sensors 43, 44 which would be activated when a user makes contact with one or more of the user contact sensors or if a user of the device moves or changes his proximity to the device sufficiently to activate one or more of the user motion or proximity sensors 44. The sensors 43, 44 could also cooperate with the means for controlling the movement of the components of the device 45 and the microchips 78' to program the arm 29' for a specific response in response to the actions of a user of the device 16. Alternatively, the means for controlling the movement 45 of the arm 29' could be programmed to operate the components of the arm 29' independently of the actions of a user of the device 16.

Figure 9:
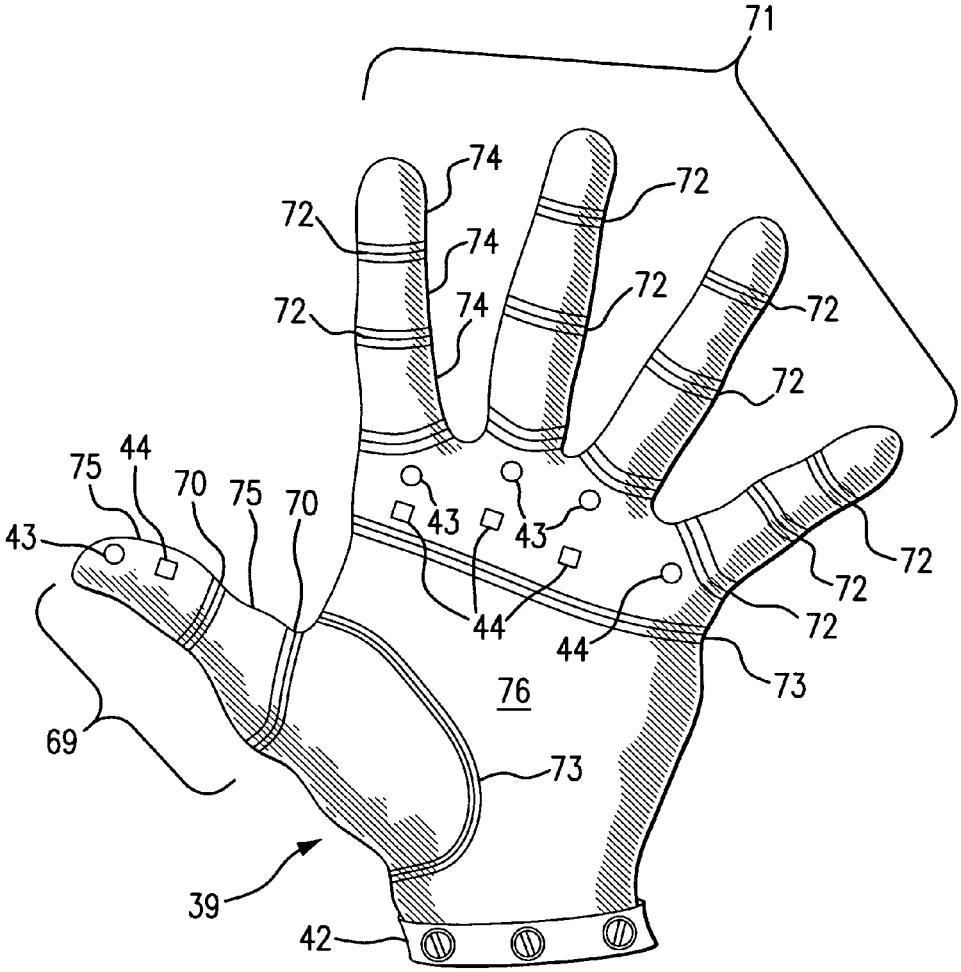
FIG. 9 is a view of a hand useful in an embodiment of the invention.

FIG. 9 shows an external view of a left hand 39 according to one embodiment of the present invention. FIG. 9 shows the left hand 39 in an open-palm or first position. The left hand 39 comprises several components and comprises a thumb 69, thumb joints 70, thumb segments 75, fingers 71, finger joints 72, finger segments 74 and palm joints 73. The thumb 69 and fingers 71 collectively comprise the digits. The fingers 71 include finger segments 74 and finger joints 72 that connect the finger segments 74 to each other and to the hand 39 and allows the finger segments 74 to move relative to each other and relative to the hand 39 by, for example, a pivotal motion towards the palm 76. The thumb 69 includes thumb segments 75 and thumb joints 70 that connect the thumb segments 75 to each other and to the hand 39. This arrangement allows the finger segments 74 and the thumb segments 75 to move relative to each other and relative to the hand 39 when the means for selectively moving the digits of the hand 50 is activated, in order to open and close the hand 39. This may be done, e.g., by a microchip 78 (shown in FIGS. 11,12 and 13) in response to signals generated by a user contact sensor 43 or a user motion sensor 44. The palm 76 of the left hand 39 and the palm 76' of the right hand 33 (shown in FIGS. 11,12 and 13) may be provided with one or more user contact sensors 43 for sensing the contact of a user of the device 16 with a user contact sensor 43 disposed on the palm 76, 76' of the hand 33, 39. The palm 76 of the left hand 39 and the palm 76' of the right hand 33 may also be provided with one or more user motion sensors 44 for sensing the motion of, or a change in the distance or proximity of, a user of the device relative to the palm 76 and 76' of the hand 33, 39.

The hands 33,39 may also be provided with means for selectively moving the digits of the hand 50 (shown in FIGS. 12 and 13) to selectively move the digits of the hand, i.e., the fingers and thumb of the hand, from an open-palm, or first position, to a closed-palm, or clenched fist, second position.

Figure 10:
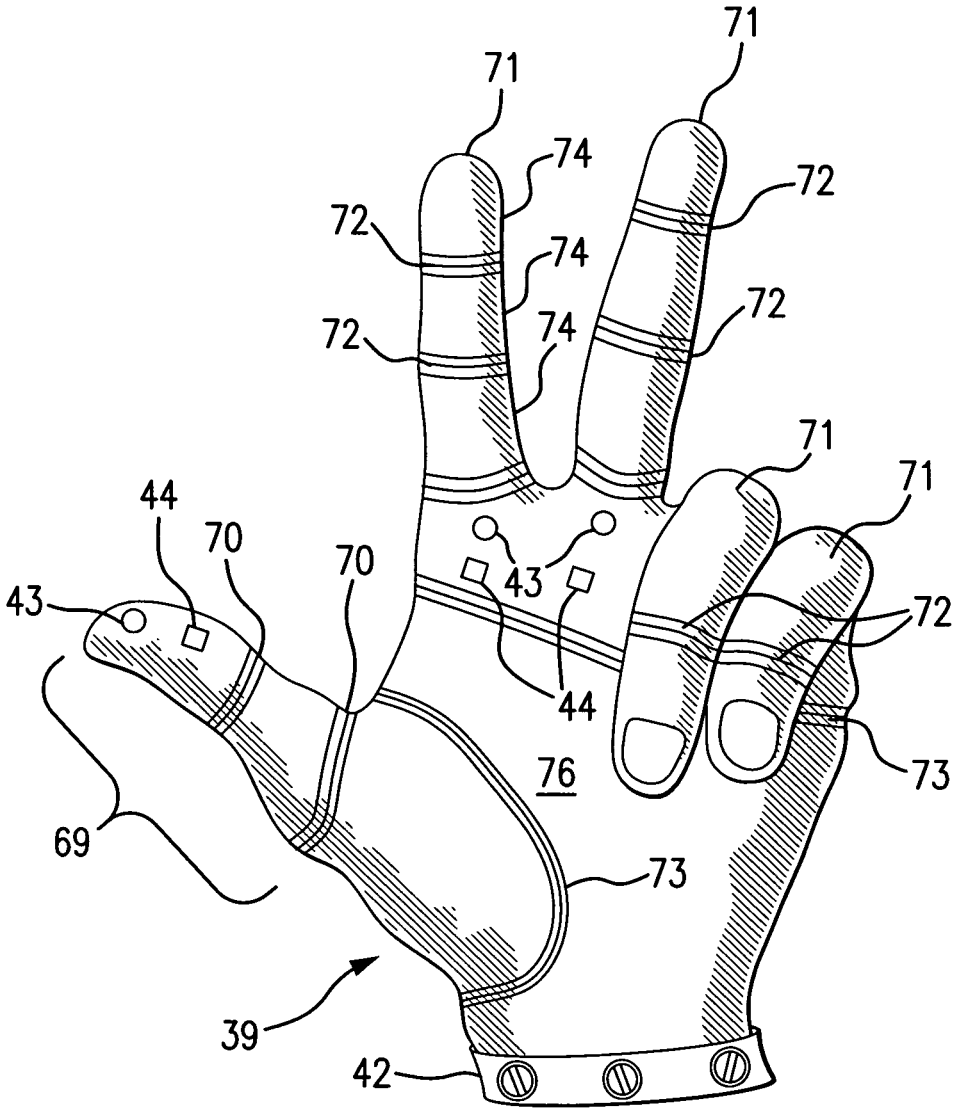
FIG. 10 shows the hand of FIG. 9 and shows how the thumb and fingers may move.

FIG. 10 shows the movement of two of the fingers 71 on the left hand 39 from an open-palm or first position to a closed-palm, or clenched fist, second position. When all of the fingers 71 and the thumb 69, i.e., the digits, move to this closed-palm, or clenched fist, second position, the closed-palm or clenched first forms a closed hand. If the hand or forearm of a user of the device 16 is disposed between the fingers 71, thumb 69 and palm 76 of the hand 39 when the hand 39 closes, the hand 39 will grasp the hand or forearm of a user of the device 16

The amount of pressure applied by the fingers 71 and thumb 69 of the hand 39 to the grasped hand or forearm of a user of the device 16, is preselected and programmed to exert a pressure that is sufficient to grasp the hand or forearm of a user of the device but is also selected to exert a pressure that is insufficient to cause injury to the user. For example, the pressure might be selected to exert less pressure on the hand or forearm of a child or a person who is small than the pressure exerted on the hand or forearm of an adult or a person who is large. In one embodiment, the pressure is selected by adjusting the microchip 78 in the hand. In another embodiment, a plurality of microchips is provided with each microchip programmed to exert a different pressure. Thus, e.g., in use, a microchip programmed to exert a larger pressure could be inserted into the hand when an adult is using the device and could be replaced with a microchip programmed to exert a smaller pressure if a child were to use the device.

Figure 11:
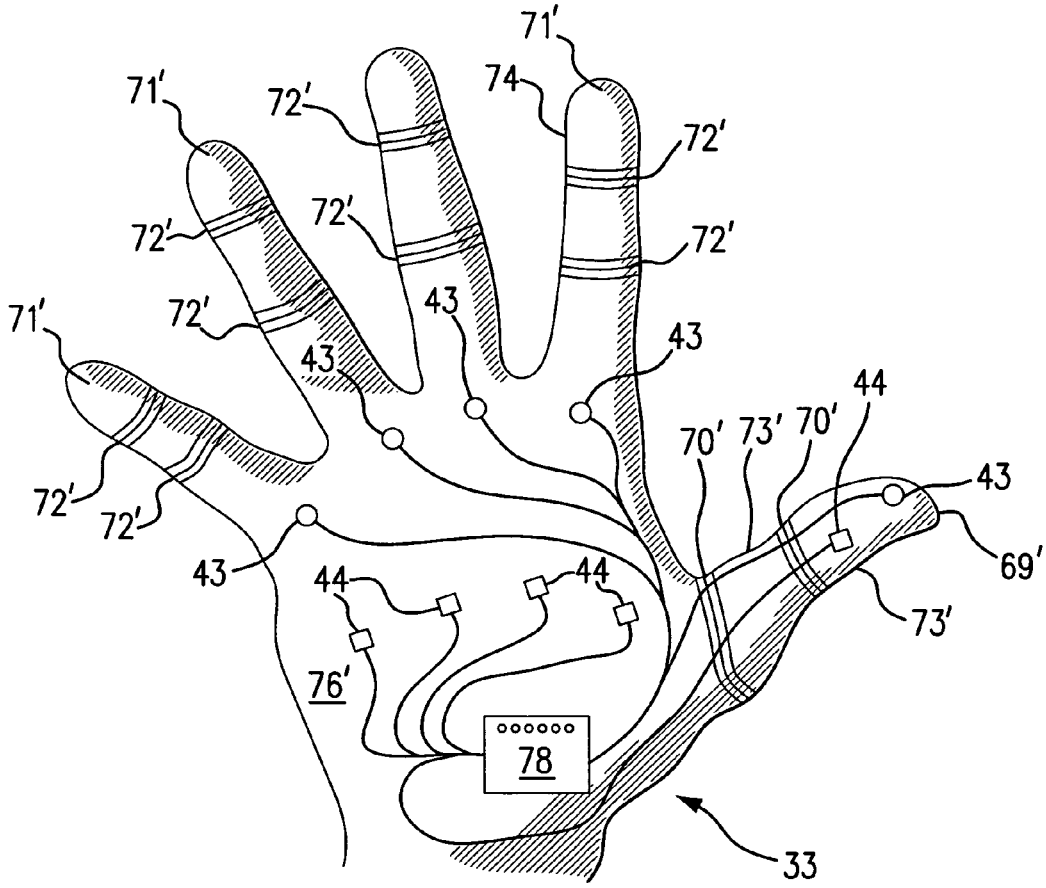
FIG. 11 is an interior view of a right hand useful in an embodiment of the invention.

FIG. 11 is an interior view of a right hand 33 according to an embodiment of the present invention. The user contact sensors 43 and the user motion sensors 44 are disposed on the palm 76' and communicate with and cooperate with the microchip 78. The hand 33 includes one or more user contact sensors 43 and user motion sensors 44 which communicate with and cooperate with the microchip 78. The fingers 71' are connected to each other and to the hand 33 by finger joints 72' and the thumb segments 73' are connected to each other and to the hand 33 by thumb joints 70'.

Figure 12:
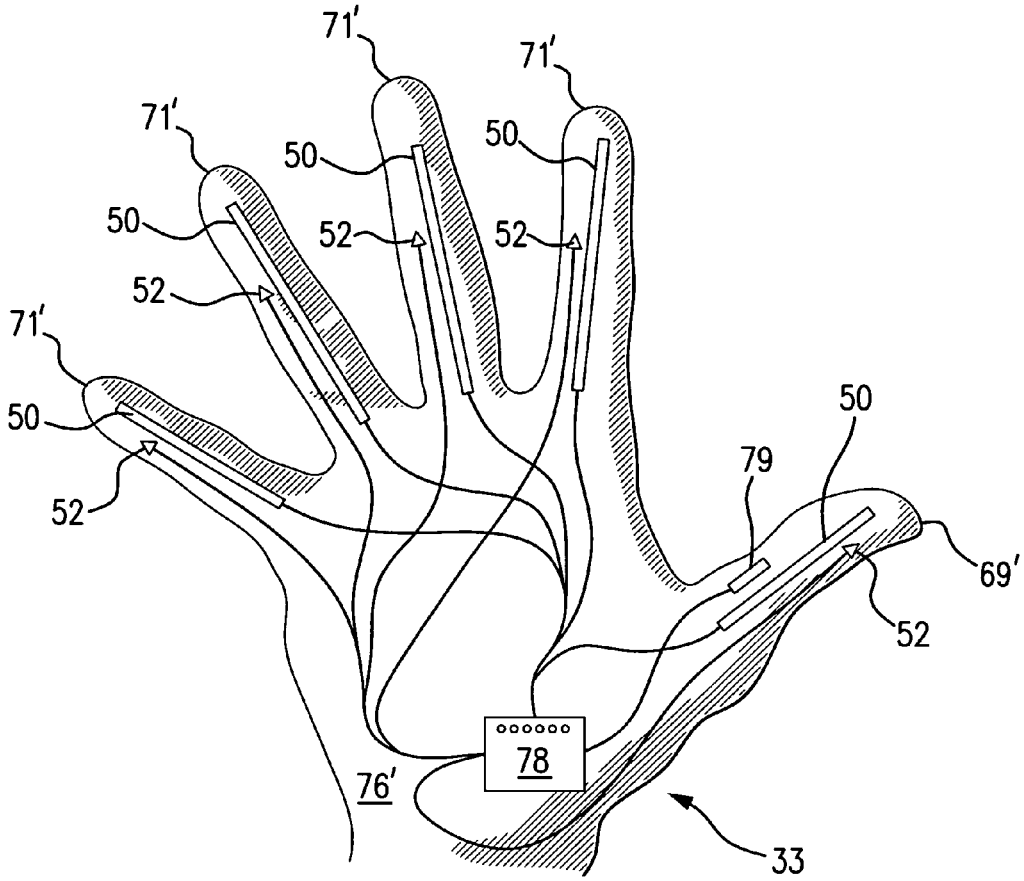
FIG. 12 is an interior view of a right hand useful in an embodiment of the invention.

As shown in FIG. 12, the microchip 78 also communicates with and cooperates with the means for selectively moving the digits of the hand 50 to selectively move the digits of the hand in order to selectively close the hand 33 and grasp the hand or forearm of a user of the device 16. The hand 33 may close in response to a user's contact with a user contact sensor 43 or in response to a user's motion or movement towards the palm 76' as sensed by a user motion sensor 44 disposed on the palm 76' (shown in FIG. 11 but not in FIG. 12 for clarity). The means for selectively moving the digits of the hand 50 communicates with the thumb 69' and fingers 71' and the microchip 78. When activated, the means for selectively moving the digits of the hand 50, in order to close the hand, would continue to cause the fingers 71' to retract until the fingers 71' and thumb 69' meet a predetermined resistance caused by contacting, e.g., the hand or forearm of a user. At that point, the microchip 78 would receive a signal from the means for detecting if a user has been grasped 52 (discussed in detail below) indicating that the preselected pressure had been reached and would send a signal to the means for selectively moving the digits of the hand 50 to stop retracting the thumb 69' and the fingers 70' so as not to injure the user.

Figure 13:
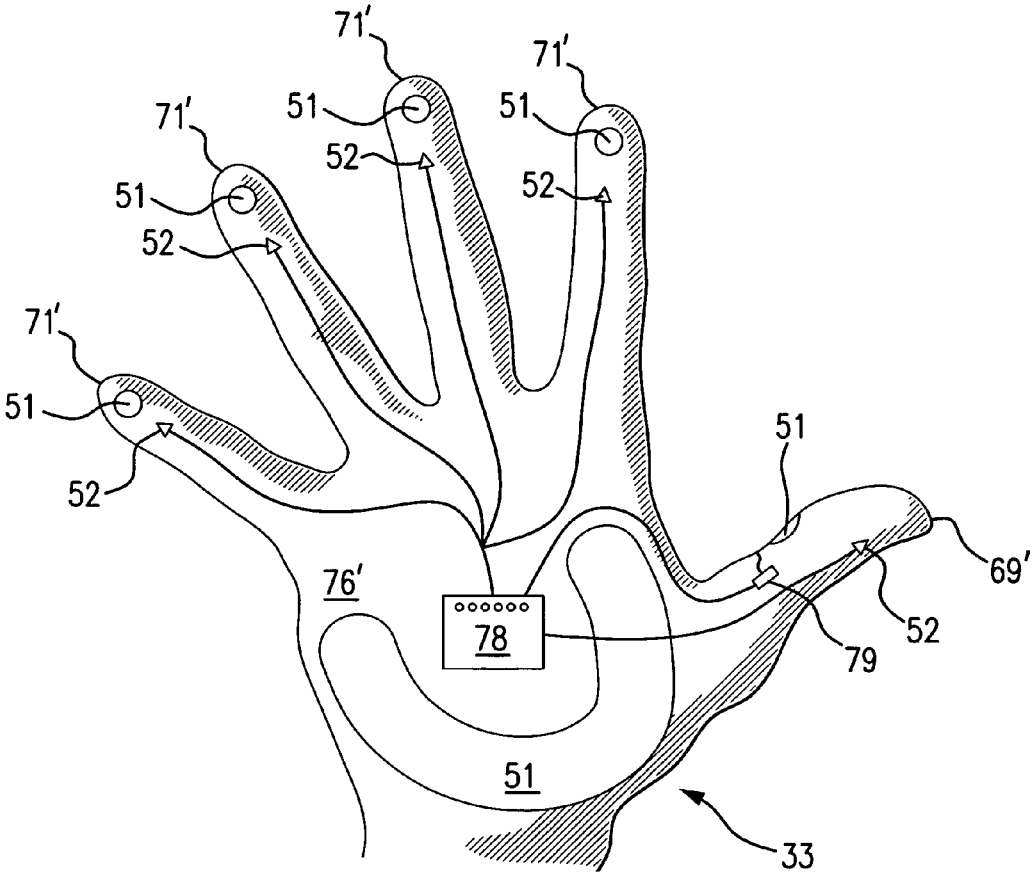
FIG. 13 is an interior view of a right hand useful in an embodiment of the invention.

The hand 33 may also be provided with a user means for releasing the hand or forearm of a user 79 that is grasped by the hand 33,39 of the device 16. The microchip 78 can be programmed to cause the means for selectively moving the digits of the hands 50 to move the fingers 71' and thumb 69' to an open-palm or first position by activating the means for releasing 79, e.g., by bending the thumb 69' to activate the microchip 78 to send a signal to the means for moving the digits of the hand 50. In this way, a user could break free of the hand after being held by it. As shown in FIGS. 12 and 13, the means for releasing 79 communicates with and cooperates with the microchip 78. The microchip 78 cooperates with the means for selectively moving the digits of the hand 50 to selectively open the hand 33 in response to the selective activation of the means for releasing 79. In one embodiment, the means for releasing is a thumb release switch 79 that communicates with the microchip 78. In this embodiment, when the thumb release switch 79 is selectively activated, e.g., by pulling on the thumb 69', the microchip 78 will send a signal to the means for moving the digits of the hand 50 to move the thumb 69' and fingers 71' from the closed-palm or clenched-fist second position to the open-palm or first position so as to release a user of the device 16 clenched by the fingers of the clenched hand 33. In an alternative embodiment, the means for releasing 79 is a release switch that is disposed on a portion of the lower arm 32, 38 and is activated by the user pressing on it.

FIG. 13 shows an embodiment of the invention in which the means for selectively moving the digits of the hand is magnetic. In this embodiment, the fingers 71' and the thumb 69' and a portion of the palm 76' are comprised of a material having a "memory" that tends to return the fingers 71' and the thumb 69' and the palm 76' to the open-palm or first position when they are not acted upon by an outside force. In this embodiment, the fingers 71' and the thumb 69' and a portion of the palm 76' are provided with a portion comprised of a selectively magnetizable material 51 that can be selectively magnetized in response to an electric current generated by the microchip 78. The microchip 78 generates the electric current in response to a user's contact with the user contact sensors 43 disposed on the palm 76' or in response to the motion of, or a change in the distance or proximity of, a user of the device as sensed by the user motion sensors 44 disposed on the palm 76'. When the magnetizable material 51 is magnetized, the fingers 71' and thumb 69' are magnetically attracted towards the magnetized material 51 disposed on the palm 76' of the hand 33. If the hand or forearm of a user of the device 16 is caught between the fingers 71', thumb 69' and the palm 76', the fingers 71', thumb 69' and palm 76' will cooperate to grasp and hold the hand or forearm of a user of the device 16.

In another embodiment, the microchip 78 may be programmed to activate the magnetizable material 51 disposed in the fingers 71' earlier than the magnetizable material 51 disposed on the thumb 69'. This will cause the fingers 71' to contract earlier than thumb 69'. Because the thumb 69' contracts after the fingers, it will cause the thumb 69' to rest outside the clenched fingers 71' so as to form a properly clenched fist.

The hand 33 may be provided with a means for detecting if the hand or forearm of a user of the device has been grasped 52. In the event that the user of the device 16 removes his hand before it is grasped, the means for detecting if the hand or forearm of a user has been grasped 52 will send a signal to the microchip 78 indicating that the hand 33 has not grasped anything. The means for detecting if the hand or forearm of a user has been grasped 52 could be, e.g., a pressure detector or a visual detector such as, e.g., an electric eye. Alternatively, the means for detecting if a portion of the user has been grasped could be a detector that measures the degree that the fingers 71' and thumb 69' have moved towards the palm 76'. Thus, e.g., if the fingers 71' and thumb 69' have moved sufficiently towards the palm 76' so as to touch the palm 76', the means for detecting if the hand or forearm of a user has been grasped 52 would sense that the movement of the fingers 71' and the thumb 69' has not been obstructed, thus, indicating that nothing had been grasped in the hand 33. This would be communicated to the microchip 78 and in response the microchip would send a signal to the means for moving the thumbs and fingers of the hand 50, 51 to return the fingers and thumb to the open or first position so that the training could continue.

In the embodiment using magnetizable material 51 to selectively move the thumbs and fingers, the means for detecting if a user has been grasped 52 will send a signal to the microchip 78 and the microchip 78 will stop the electrical flow to the selectively magnetizable material 51 which will terminate the magnetic attraction of the fingers 71' and thumb 69' towards the palm 76', and because of their memory, will cause the thumb 69' and the fingers 71' and the palm 76' to return to their open-palm or first position.

Figure 15:
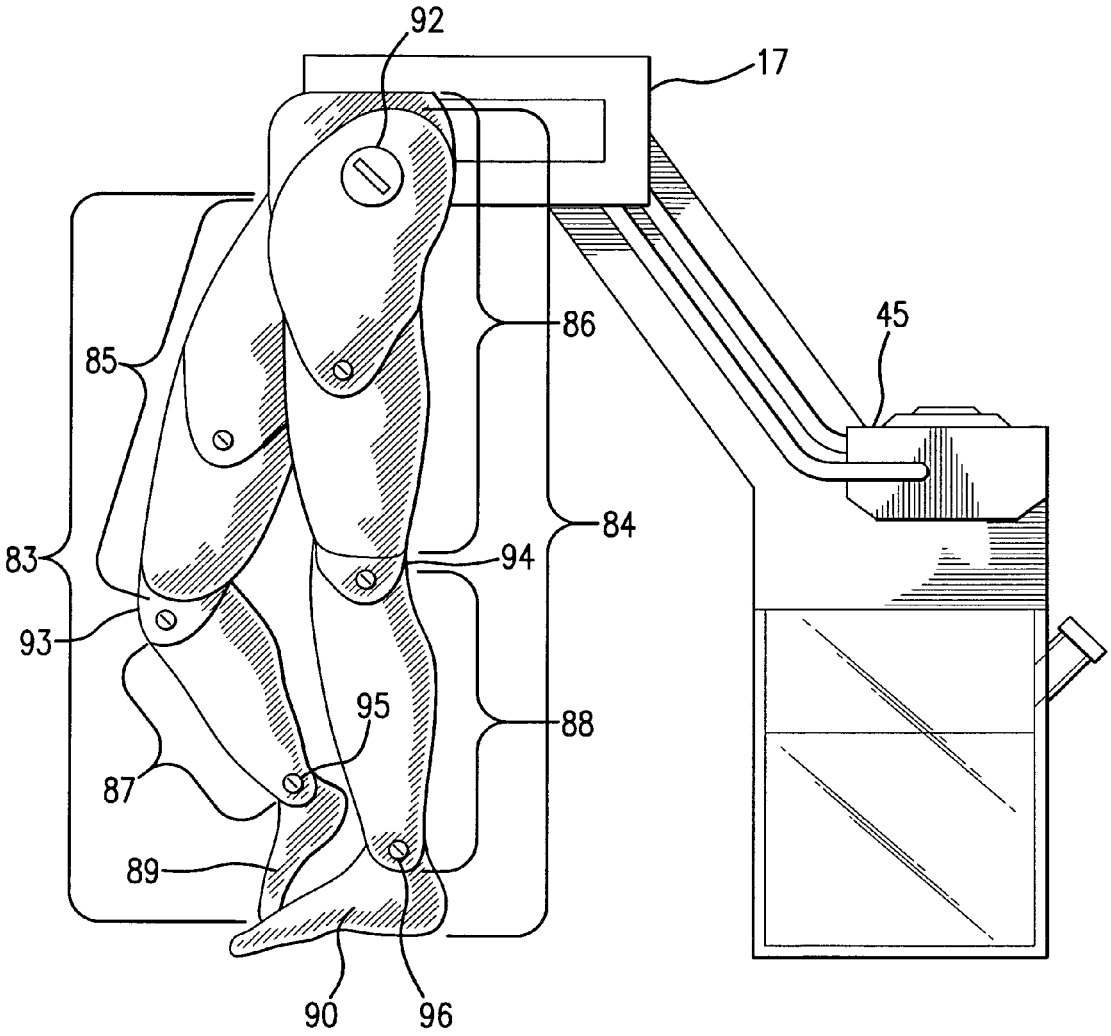
FIG. 15 is a side view of an embodiment in accordance with the invention further comprising legs that may be attached to the torso or base.
Figure 16:
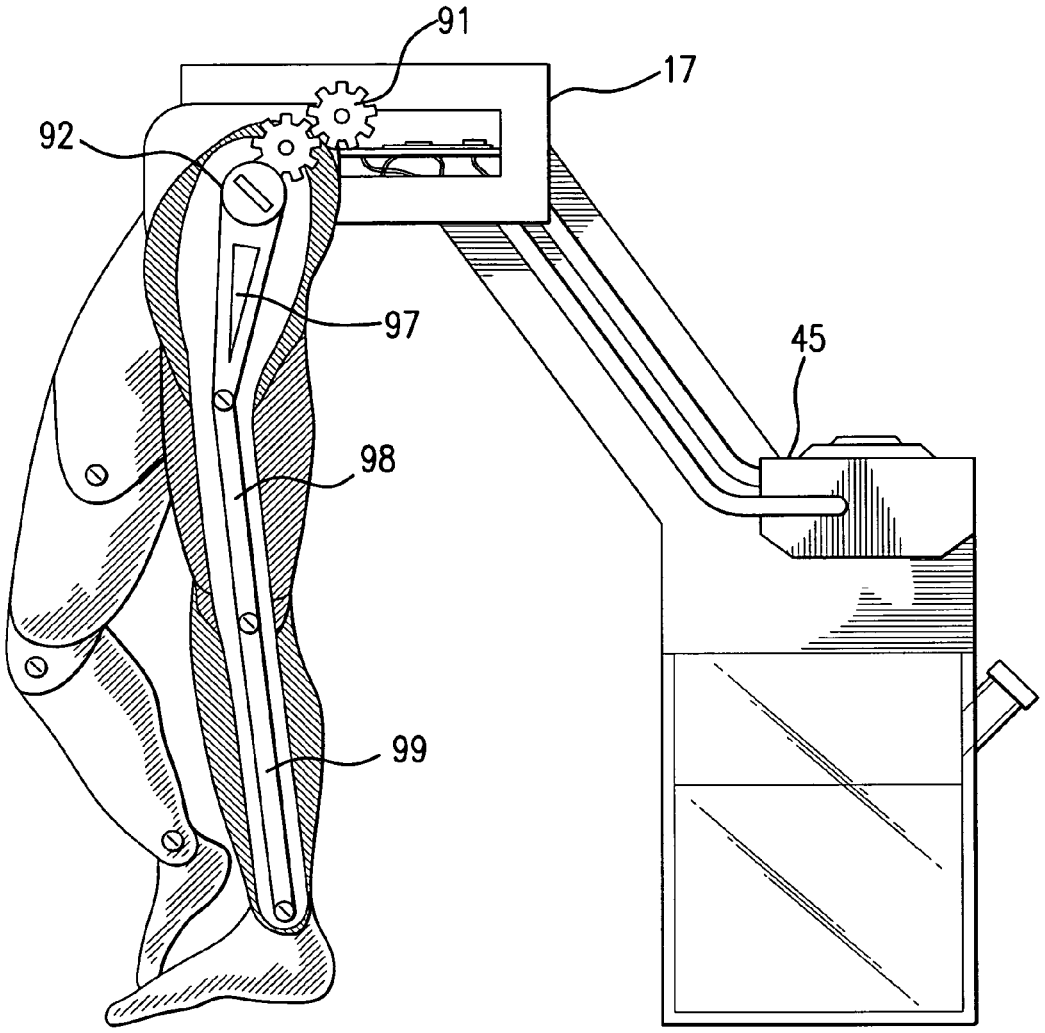
FIG. 16 is an interior side view of the legs shown in FIG. 15.

Referring to FIGS. 15 and 16, in an alternative embodiment right leg 83 and left leg 84 may be attached to the base 17. Right leg 83 may include a right upper leg 85 and a right lower leg 87, and a right foot 89. The right leg 83 may also include sensors 43, 44 and means for moving the leg 91. The right upper leg 85 may be connected to the base 17 by a hip connector 92. The hip connector 92 may be, e.g., a swivel-type connector, a plurality of gears type of connector, or a ball-and-socket type connector. The hip connector 92 allows the right leg 83 to move relative to the base 17, e.g., between a first raised and a second lowered position, e.g., when the right leg 83 is activated by the sensors 43,44 in response to any stimulus provided by a user. Alternatively, the right leg 83 may be programmed to operate independently of any stimulus provided by a user of the device 16. The right lower leg 87 may be connected to the right upper leg 85 by a right upper leg and lower leg knee joint connector 93 and the right foot 89 may be connected to the lower right leg 87 by a right ankle joint connector 95. The right upper leg and right lower leg knee joint connector 93 and right ankle joint connector 95 may be a pivotal attachment that allows the right lower leg 87 to move pivotally relative to the right upper leg 85 and allows the right foot 89 to move pivotally relative to the right lower leg 87, e.g., when activated by the user contact sensors 43 or the user motion sensors 44 in response to the actions of a user of the device 16 or when programmed to operate independently of any action by a user of the device 16.

The left leg 84 may include a left upper leg 86 and a left lower leg 88 and a left foot 90. The left leg 84 may also include sensors 43, 44 and means for moving the leg 91. The left upper leg 86 may be connected to the base 17 by a hip connector 92. The hip connector 92 may be, e.g., a swivel-type connector, a plurality of gears type of connector, or a ball-and-socket type connector. The hip connector 92 allows the left leg 84 to move relative to the base 17 e.g., between a first raised and a second lowered position, e.g., when the left leg 84 is activated by the sensors 43,44 in response to any stimulus provided by a user. Alternatively, the left leg 84 may be programmed to operate independently of any stimulus provided by a user of the device 16. The left lower leg 88 may be connected to the left upper leg 86 by a left upper leg and left lower leg knee joint connector 94 and the left foot 90 may be connected to the left lower leg 88 by a left ankle joint connector 96. The left knee connector 94 and left ankle connector 96 may be a pivotal attachment that allows the left lower leg 88 to move pivotally relative to the left upper leg 86 and allows the left foot 90 to move pivotally relative to the left lower leg 88, e.g., when activated by the user contact sensors 43 or user motion sensors 44 in response to the actions of a user of the device 16 or when programmed to operate independently of any action by a user of the device 16.

FIG. 16 is an internal side view of an embodiment of a leg constructed in accordance with the invention and shows that the legs 83, 84 may further comprise: a hip rod 97 connected to an upper leg rod 98 that is connected to lower leg rod 99. The hip rod 97, and upper leg rod 98 and the lower leg rod 99 may be comprised of any material that is sufficiently rigid, durable and suitable for this use, e.g., metal, plastic or fiberglass. The legs 83, 84 are connected to the base 17 by a hip connector 92, e.g., plurality of gears comprising a gear connector.

As previously discussed, FIGS. 15 and 16 show that the device 16 may further include a means for controlling the movements of the components of the device 45, e.g., a control panel that may also comprise a computer that can be used to program the sensors 43, 44, and the means for moving the legs 83, 84 to move the legs in response to, or independently of, the actions of a user of the device 16.

What is claimed is:

1. A device for competitive training, comprising:

a base;

a torso attached to the base, the torso having a right side, a left side, a top end, and a bottom end, the bottom end having a right side and a left side;

a torso waist joint connector for attaching the bottom end of the torso to the base;

a head attached to the top end of the torso;

a head neck joint connector for attaching the head to the top end of the torso;

a right arm attached to the right side of the torso and a left arm attached to the left side of the torso;

a right arm shoulder joint connector for attaching the right arm to the right side of the torso, and a left arm shoulder joint connector for attaching the left arm to the left side of the torso;

means for moving the torso;

means for moving the head;

means for moving the arms;

a plurality of user motion sensors disposed on the device for sensing the motion of a user of the device, the user motion sensors communicating with and cooperating with the means for moving the torso, the means for moving the head, and the means for moving the arms to move the torso, head, and arms in response to the motion of a user of the device sensed by the user motion sensors;

a plurality of user contact sensors disposed on the device for sensing the contact of a user of the device with the user contact sensors, the user contact sensors communicating with and cooperating with the means for moving the torso, the means for moving the head, and the means for moving the arms, to move the torso, head, and arms in response to the contact of a user of the device sensed by the user contact sensors;

means for controlling the movements of the torso, head, and arms, the means for controlling the movements communicating with the user motion sensors, the user contact sensors, and the means for moving the torso, and the means for moving the head, and the means for moving the arms to selectively control the movements of the torso, head, and arms;

wherein the right arm is comprised of a right upper arm attached to a right lower arm; wherein the left arm is comprised of a left upper arm attached to a left lower arm; wherein the right upper arm communicates with the right arm shoulder joint connector, and wherein the left upper arm communicates with the left arm shoulder joint connector;

a right hand attached to the right lower arm and a left hand attached to the left lower arm; and right means for sensing an impact of the right hand of the device with a user of the device, the right means for sensing the impact disposed on the right hand; and further comprising left means for sensing an impact of the left hand of the device with a user of the device, the left means for sensing the impact disposed on the left hand; wherein the right and left means for sensing the impact cooperate with the means for moving the right arm and the means for moving the left arm and the means for moving the arms and means for controlling the movements of the torso, head, and arms so as to decelerate a thrust of the right arm and the left arm upon sensing contact of the right hand and the left hand with a user of the device.

2. The device according to claim 1, wherein the user motion sensors are selected from the group consisting of infrared, ultrasonic and microwave sensors.

3. The device according to claim 1, wherein the user contact sensors comprise pressure sensors.

4. The device according to claim 1, wherein the means for moving the torso, head and arms are selected from the group consisting of electronic, hydraulic, magnetic, compressed air, pneumatic, and counter-weights.

5. The device of claim 1, wherein the means for controlling the movement of the torso, head, and arms comprises a computer.

6. The device of claim 1, wherein the means for controlling the movement of the torso, head, and arms comprises manually operated controls.

7. The device of claim 1, wherein the means for controlling the movement of the torso, head, and arms is programmed to move the torso, head, and arms in response to actions of a user of the device.

8. The device of claim 1, wherein the means for controlling the movement of the torso, head, and arms is programmed to move the torso, head, and arms independently of any actions of a user of the device.

9. The device according to claim 7 or 8, wherein the means for controlling the movement of the torso, head, and arms is programmed to move the torso, head, and arms in a predetermined pattern.

10. The device according to claim 7 or 8, wherein the means for controlling the movement of the torso, head, and arms is programmed to move the torso, head, and arms in a random pattern.

11. The device according to claim 1, wherein the torso waist joint connector comprises a swivel connector and the head neck joint connector comprises a flexible corrugated accordion type connector.

12. The device according to claim 1, wherein the torso waist joint connector is provided with a means for adjusting the height of the torso above the base.

13. The device according to claim 1, wherein the right and left arm shoulder joint connectors are selected from the group consisting of swivel connectors and ball-and-socket connectors.

14. The device according to claim 13, further comprising:

a right upper arm and a right lower arm elbow joint connector disposed between the right upper arm and the right lower arm; and a left upper arm and a left lower arm elbow joint connector disposed between the left upper arm and the left lower arm.

15. The device according to claim 14, wherein the right upper arm and right lower arm elbow joint connector and the left upper arm and the left lower arm elbow joint connector are selected from the group consisting of swivel connectors and pivotal connectors.

16. The device according to claim 15, wherein the right and left hands are removable.

17. The device according to claim 15, wherein the right hand is connected to the right lower arm by a right wrist joint connector and wherein the left hand is connected to the left lower arm by a left wrist joint connector.

18. The device of claim 17, wherein the right and left wrist joint connectors comprise a swivel wrist joint connector.

19. The device according to claim 15, wherein the right and left hands are shaped to form an open hand comprising a palm, fingers and a thumb.

20. The device according to claim 19, wherein there is no open space between the fingers and there is no open space between the fingers and the thumb.

21. The device according to claim 15, wherein the right and left hands are shaped to form a clenched fist.

* * * * *